US006655461B2

(12) United States Patent
Eslinger et al.

(10) Patent No.: US 6,655,461 B2
(45) Date of Patent: Dec. 2, 2003

(54) STRADDLE PACKER TOOL AND METHOD FOR WELL TREATING HAVING VALVING AND FLUID BYPASS SYSTEM

(75) Inventors: David M. Eslinger, Broken Arrow, OK (US); Randolph J. Sheffield, Missouri City, TX (US); Mark C. Oettli, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 24 days.

(21) Appl. No.: 10/113,500

(22) Filed: Apr. 1, 2002

(65) Prior Publication Data

US 2002/0153142 A1 Oct. 24, 2002

Related U.S. Application Data

(60) Provisional application No. 60/284,590, filed on Apr. 18, 2001.

(51) Int. Cl.[7] ..... E21B 43/16; E21B 43/26; E21B 34/10; E21B 33/26

(52) U.S. Cl. ..... 166/305.1; 373/387; 373/191; 373/186; 373/202

(58) Field of Search ..... 166/119, 121, 166/127, 131, 133, 142, 145, 146, 149, 185, 186–188, 191–202, 279, 205.1–373, 287

(56) References Cited

U.S. PATENT DOCUMENTS 3,797,572 A * 3/1974 Mignotte ..... 166/127
3,861,465 A * 1/1975 Mignotte ..... 166/255.1
4,270,608 A * 6/1981 Hendrickson et al. ..... 166/278
4,567,944 A * 2/1986 Zunkel et al. ..... 166/120
4,590,995 A * 5/1986 Evans ..... 166/127
4,627,488 A * 12/1986 Szarka ..... 166/142
4,671,352 A * 6/1987 Magee et al. ..... 166/186
5,020,600 A * 6/1991 Coronado ..... 166/387
5,044,444 A * 9/1991 Coronado ..... 166/387
5,350,018 A * 9/1994 Sorem et al. ..... 166/250.07
5,361,836 A * 11/1994 Sorem et al. ..... 166/187
6,533,037 B2 * 3/2003 Eslinger et al. ..... 166/319

OTHER PUBLICATIONS

"Auto Fill Valve", Petro–Tech Tools, Inc., Unit No. 20501 TECH, Oct. 20, 1998, pp 1–3.
"Remedial & Stimulatin", Baker Hughes Incorporated, 1996, p. 28 with cover page and Region/Area Locations.

* cited by examiner

*Primary Examiner*—David Bagnell
*Assistant Examiner*—Brian Halford
(74) *Attorney, Agent, or Firm*—Wayne I. Kanak; Brigitte L. Jeffery; John J. Ryberg

(57) ABSTRACT

A straddle packer tool for treatment of wells has a tool body supporting sealing elements in spaced relation for defining a sealed annulus zone within a wellbore. The tool body defines a treatment fluid passage having treatment ports that open to the sealed annulus zone for formation fracturing or other well treatment. The tool body has a bypass passage therethrough which is isolated from the treatment fluid passage and communicates with the wellbore above and below the sealed annulus zone. A check valve permits downward flow of well fluid from the bypass passage into the wellbore below the tool and prevents upward flow of fluid into the bypass passage. Bypass ports conduct fluid flow to and from the bypass passage and the wellbore above and below the sealed annulus zone. A packer actuated bypass valve is opened or closed to control the flow of well fluid within the bypass passage.

23 Claims, 3 Drawing Sheets

STRADDLE PACKER TOOL AND METHOD FOR WELL TREATING HAVING VALVING AND FLUID BYPASS SYSTEM

CROSS-REFERENCE TO RELATED APPLICATION

This application claims priority from United States Provisional Application No. 60/284,590, filed on Apr. 18, 2001, which Provisional Application is incorporated herein by reference for all purposes.

BACKGROUND OF THE INVENTION

1. Field of the Invention

This invention relates generally to formation interval straddle packer tools that are used in casing lined wellbores for formation zone fracturing or other formation treating operations. More particularly, the present invention concerns a straddle packer tool having a valving system which permits bypass of well fluid below the tool to the wellbore above the tool, permits well formation treatment, such as formation fracturing, to be accomplished, and permits bypass of well fluid above the tool to the wellbore below the tool.

2. Description of Related Art

After a wellbore has been drilled, various completion operations are typically performed to enable production of wellbore fluids. Examples of such completion operations include the installation of casing, production tubing, and various packers to define or isolate zones within the wellbore. Also, a perforating string is lowered into the wellbore and fired to create perforations in the surrounding casing lining the wellbore and to extend the perforations into the surrounding formation.

To further enhance the productivity of the formation, fracturing of the formation may be performed. Typically, fracturing fluid is pumped into the wellbore to fracture the formation so that fluid flow conductivity in the formation is improved to provide enhanced fluid flow into the wellbore.

A typical fracturing string includes an assembly carried by tubing, which may be coiled tubing, or jointed tubing such as drill pipe, with the assembly including a straddle packer tool having sealing elements to define a sealed interval into which fracturing fluids may be pumped for communication with the surrounding formation. The fracturing fluid is pumped down the tubing and through one or more ports in the straddle packer tool into the sealed interval.

Straddle packer tools used for fracturing typically incorporate one or more bypass passages to permit fluid communication between zones above and below the tool. Such bypass passages facilitate run-in of the tool by allowing fluid in the wellbore to move upwardly through the tool as it is run into the well. Likewise, such bypass passages also facilitate pulling the tool out of the well, especially from deep treating depths, without experiencing excessive pulling loads.

However, despite the advantages of bypass passages, they also present a major disadvantage in that they permit pressurized wellbore fluids from below the sealed interval to migrate through the straddle packer tool during fracturing. The presence of such pressurized fluids in the wellbore above the straddle packer tool may make it impossible for the operator controlling the fracturing process to identify problems with the process, such as the breakthrough of fracturing fluids through the formation and into the wellbore above the straddle packer tool.

Additionally, as sand and debris above the straddle packer tool can potentially stick the tool in the well, bypass passages may have screens over their inlet openings to prevent sand and wellbore debris from flowing from the lower zones to the upper zones above the straddle packer tool.

Therefore, a method and apparatus is needed for bypassing wellbore fluids through straddle packers during run-in and pull-out while preventing fluid bypass during fracturing and other well treating operations.

BRIEF SUMMARY OF THE INVENTION

The present invention relates to the use of a check valve in a straddle packer tool bypass passage that prevents flow from the lower zone to the upper zone through the bypass passage during fracturing operations. However, free flow is allowed through the check valve from the upper zone to the lower zone when the straddle packer tool is pulled out of the wellbore. This invention thus allows easy pulling from deep treating depths since displaced fluid can flow from the upper zone to the lower zone through the bypass passage and check valve carrying with it any sand and debris which may have accumulated above the tool.

At times, the lower sealing member of the tool is defined by two oppositely directed lower cup packers. In this case, the lower cup packer is oriented with its open end directed downwardly and prevents flow from zones below the tool from carrying sand and debris to the sealed annulus zone or interval between the upper and lower sealing members. When such a packer arrangement is used, a sleeve valve is used to allow fluid to bypass the check valve when running the tool into the well, thus permitting well fluid displaced by the tool to be displaced through the tool to the wellbore above the tool. The sleeve valve is energized for movement to its closed position by lower packer movement responsive to increase of treatment fluid pressure within the sealed annulus zone. Since the treatment fluid passage and the bypass passage of the tool are not in communication, any treatment fluid within the treatment fluid passage is not compromised in any manner whatever by the bypassed well fluid. When interval pressure is applied during fracturing, the cup packers cause the sleeve valve to close and prevent further flow of fluid through the bypass passage of the tool from lower to upper zones. The sleeve valve remains closed when the straddle packer tool is pulled out of the well and the check valve opens to allow downward flow of well fluids through the bypass passage of the tool and into the wellbore below the tool.

BRIEF DESCRIPTION OF THE DRAWINGS

So that the manner in which the above recited features, advantages and objects of the present invention are attained and may be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic representation of an example embodiment of a fracturing tool string in a wellbore;

FIGS. 2A–2C are vertical cross-sectional views illustrating a straddle packer tool having a valve assembly in accordance with an embodiment used with the fracturing string of FIG. 1;

FIG. 3 is a cross-sectional view showing the check valve assembly of FIG. 2C in greater detail;

FIG. 4 is a cross-sectional view of the check valve assembly of FIG. 3 taken along the line 4—4; and FIG. 5 is a vertical cross-sectional view showing an alternative embodiment of the sliding sleeve valve assembly of FIG. 2C.

DETAILED DESCRIPTION OF THE INVENTION

In the following description, numerous details are set forth to provide an understanding of the present invention. However, it will be understood by those skilled in the art that the present invention may be practiced without these details and that numerous variations and modifications from the described embodiments may be possible. For example, although reference is made to a fracturing string in the described embodiments, other types of tools may be employed in further embodiments without departing from the spirit and scope of the present invention.

As used herein, the terms "up" and "down"; "upward" and "downward"; "upstream" and "downstream"; and other like terms indicating relative positions above or below a given point or element are used in this description to more clearly describe some embodiments of the invention. However, when applied to equipment and methods for use in wells that are deviated or horizontal, such terms may refer to "left to right" or "right to left", or other relationship as appropriate.

Figure 1:
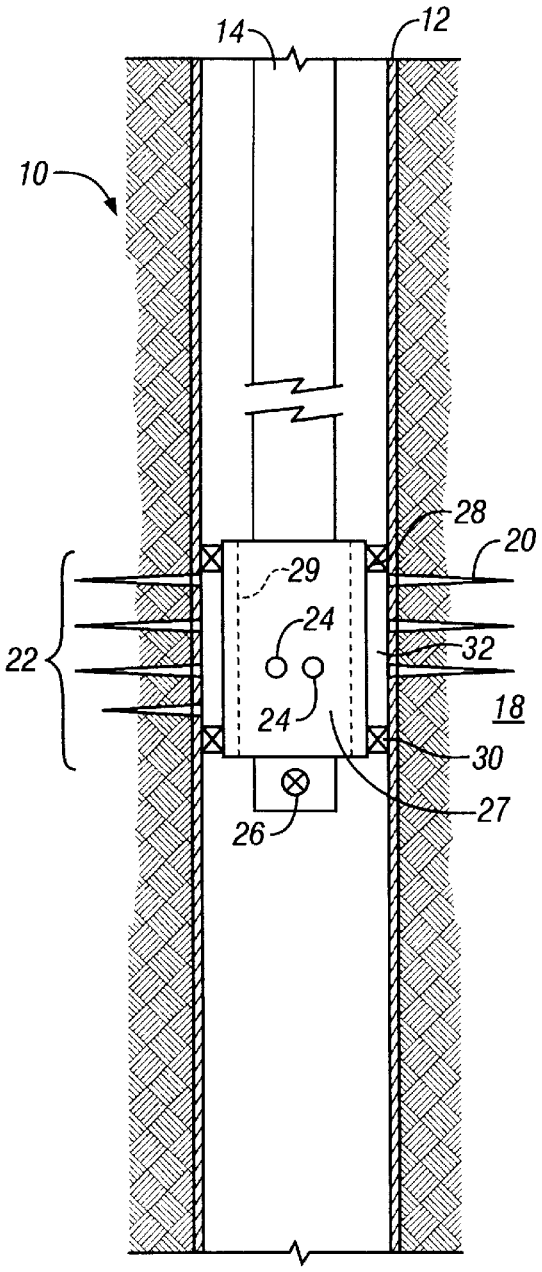

Referring now to the drawings and first to FIG. 1, a fracturing tool string is positioned in a wellbore shown generally at 10. The wellbore 10 is typically lined with casing 12 and extends through an earth formation 18 that has been perforated to form perforations 20. To perform a fracturing operation, a straddle packer tool 22 carried on a tubing 14 (e.g., a continuous tubing such as coiled tubing or a jointed tubing such as drill pipe or any other type of jointed tubing or pipe) is run into the wellbore 10 to a depth adjacent the perforated earth formation 18. The straddle packer tool 22 includes upper and lower sealing elements (e.g., packers) 28 and 30. When set, the sealing elements 28 and 30 define a sealed annulus zone 32 outside the housing of the straddle packer tool 22. The sealing elements 28 and 30 are carried on a ported sub 27 that has one or more ports 24 to enable communication of fracturing fluids pumped down the tubing 14 to the sealed annulus zone 32. The straddle packer tool 22 further includes a bypass passage defined in part by bypass channels 29 to facilitate running the tool into the well by enabling the displacement of fluid through the tool as it moves downward.

In accordance with an embodiment of the present invention, a valve assembly 26 is connected below the ported sub 27. When the straddle packer tool 22 is run into the well in preparation for a well treatment operation such as formation fracturing, the valve assembly 26 is open to permit displaced well fluid to be bypassed upwardly through the bypass passage of the tool.

Figure 2A:
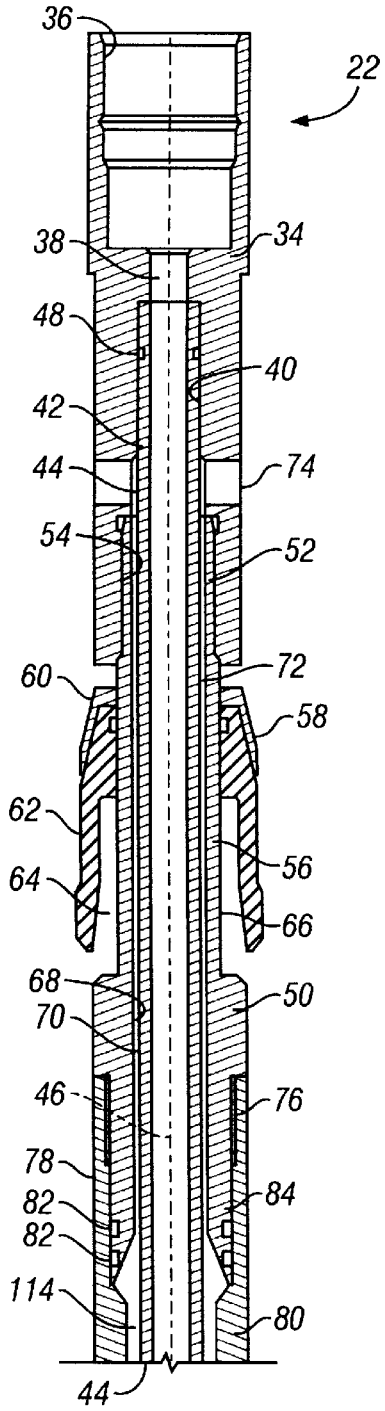
Figure 2B:
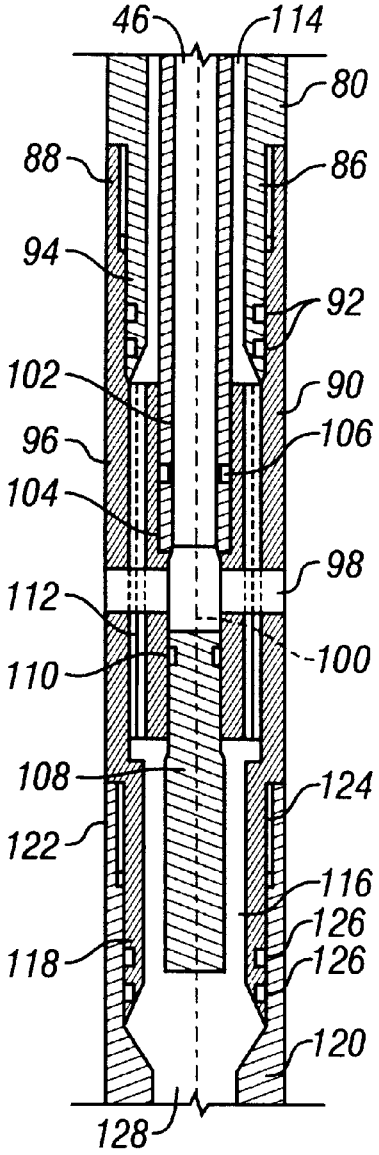
Figure 2C:
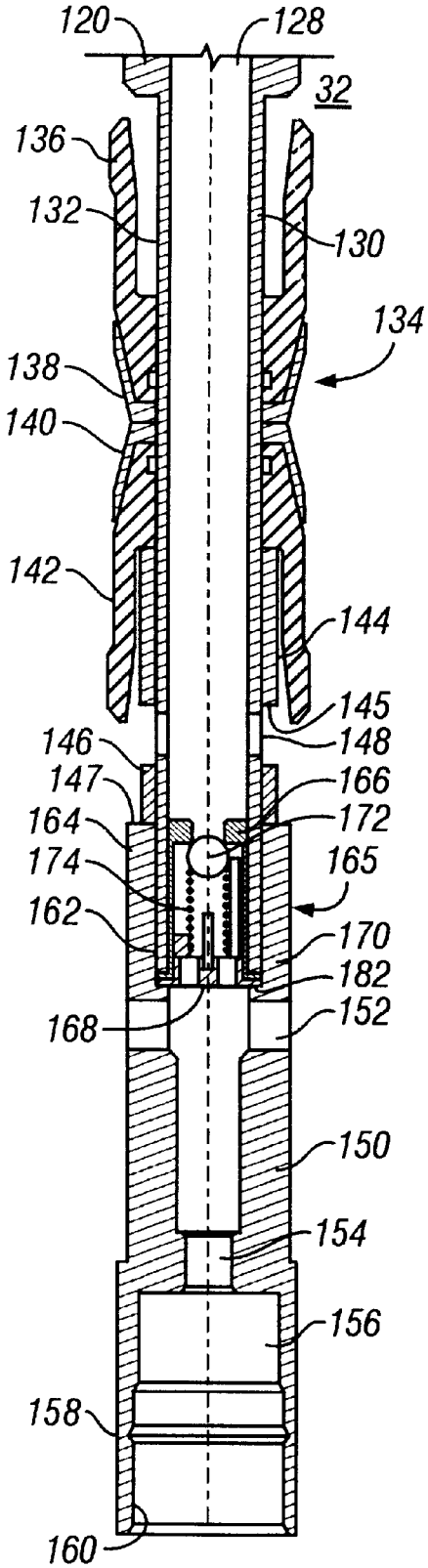

Referring now to the vertical cross-sectional views of FIGS. 2A, 2B and 2C, which respectively show in detail the upper, intermediate, and lower sections of a straddle packer tool, shown in detail generally at 22, which embodies the principles of the present invention and represents the preferred embodiment. The straddle packer tool 22 incorporates an upper connector section or mandrel 34 having an internally threaded connector receptacle 36 for receiving a tubing connector of a tubing string that is employed for running and retrieving the straddle packer tool 22 and for conducting pressurized treatment fluid such as fracturing slurry to a treatment fluid passage 38 of the upper connector section 34. The upper connector section 34 also defines a conductor receptacle 40 within which is received the upper end 42 of a fluid conductor conduit 44 which defines a treatment fluid passage 46 for conducting fracturing slurry or other treatment fluid into the straddle packer tool 22. The upper end 42 of the fluid conductor conduit 44 is sealed with respect to the upper connector section 34 by an annular seal 48. An upper packer mandrel 50 is provided, having its tubular upper connector end 52 received in threaded engagement within an internally threaded receptacle 54 at the lower end of the upper connector section 34. The upper packer mandrel 50 has an elongate tubular section 56 to which is mounted an upper sealing element 58 having a seal retainer 60 with a flexible cup packer 62 seated within the seal retainer. The cup packer 62 has a closed end which is mounted to the seal retainer 60 and a larger annular open end which is oriented to face a source of fluid pressure. The upper sealing element 58 is thus of the cup packer variety which is expanded by pressure exposed to its larger open resilient or flexible end for expanding to establish sealing engagement within the wellbore or well casing by fluid pressure that enters an annulus 64 between the open end of the flexible cup packer 62 and a cylindrical outer surface 66 of the elongate tubular section 56 of the upper packer mandrel 50.

The upper packer mandrel 50 defines an internal surface 68 which is of greater dimension as compared with the dimension of an external surface 70 of the fluid conductor conduit 44, thus providing an annular space or annulus 72 which defines a flow passage which constitutes a portion of a bypass passage extending through the tool. This flow passage is in communication with fluid transfer ports 74 that are defined in the upper connector section 34. As will be explained in greater detail below, fluid within the annulus between the tool and the well casing and above the upper sealing element 58 can be conducted through the tool such as during pull-out or retrieval of the tool following a fracturing operation or other treatment that is conducted within the well.

At its lower end, the upper packer mandrel 50 is provided with an externally threaded connector section 76 which is received in threaded engagement with an internally threaded connector section 78 of a tubular bypass mandrel 80. Seals 82 are carried within external seal grooves of a tubular extension 84 of the upper packer mandrel 50 and establish sealing with an internal surface of the tubular bypass mandrel 80. Likewise, the tubular bypass mandrel 80 is provided with an externally threaded connector section 86 that is received in threaded engagement with an internally threaded connector section 88 of a treatment mandrel 90. Seals 92 are carried within external seal grooves of a tubular extension 94 of the tubular bypass mandrel 80 and establish sealing with an internal surface of the treatment mandrel 90. The treatment mandrel 90 defines a thick walled central section 96 having treatment ports 98 that are in communication with a fluid passage section 100 that is located centrally of the thick walled central section 96 and is in fluid communicating registry with the treatment fluid passage 46. The lower end 102 of the fluid conductor conduit 44 is located within a receptacle 104 of the thick walled central section 96 and is sealed with respect thereto by an annular sealing member 106. The treatment fluid passage 46 of the fluid conductor conduit 44 is open to the fluid passage section 100 for communication of treatment fluid to the treatment ports 98. Below the treatment ports the fluid passage section 100 is closed by a plug member 108 which is sealed with respect to the internal wall of the fluid passage section 100 by an annular sealing element 110. The plug member 108 may simply be a blind plug member for closure of the fluid passage section 100, and may be threaded to or otherwise retained within the fluid passage section 100. Alternatively, the plug member 108 may take the form of an electronic memory device having the capability of detecting and recording various well treatment parameters such as, for example, injection pressure, volume of fluid flow, well fluid pressure below the straddle packer tool. The treatment mandrel 90 is provided with an externally threaded connector extension 118 which is received by an internally threaded connector section 122 of a lower packer and valve mandrel 120.

As mentioned above, it is desirable, to achieve appropriate treatment of the well, to flow displaced well fluid through the straddle packer tool during run-in and to drain well fluid through the tool during run-out. To accomplish this feature the thick-walled central section 96 of the treatment mandrel 90 defines a plurality of bypass passages 112 having their upper ends in communication with an annulus 114 between the fluid conductor conduit 44 and the internal wall surface of the tubular bypass mandrel 80. The annulus 114 defines a portion of a bypass passage through the straddle packer tool 22 and is in communication with the annular space or annulus 72 between the fluid conductor conduit 44 and the upper packer mandrel 50. The bypass passages 112 are also in communication with an annulus 116 located below the thick walled central section 96 of the treatment mandrel 90 and being defined between the plug member 108 and the tubular connection extension 118 of the treatment mandrel 90. The annulus 116 and the central passage 128 below the plug member 108 also define portions of a bypass passage through the tool.

Lower packer mandrel 120 is provided with an upper tubular, internally threaded connector section 122 within which is received an externally threaded connector section 124 of the treatment mandrel 90. Seals 126 establish sealing of the tubular connection extension 118 of the treatment mandrel 90 within the upper end of the lower packer mandrel 120. The lower packer mandrel 120 defines an elongate reduced diameter tubular section 130 which defines an external cylindrical surface 132. A lower sealing element, which may be a double packer assembly shown generally at 134, is movably mounted on the elongate reduced diameter tubular section 130 for movement relative to the external cylindrical surface 132. The double packer assembly 134 is of the oppositely directed double cup variety having an upper flexible sealing cup 136 composed of rubber or any other rubber-like or elastic material which is supported by a cup retainer 138. Another cup retainer 140 is located immediately below the cup retainer 138 and provides support for a lower flexible sealing cup 142. Since the flexible sealing cups 136 and 142 are oppositely directed, collectively, the lower sealing element 134 is capable of pressure energized sealing by upstream pressure from the sealed annulus zone 32 or pressure within the well below the double sealing assembly 134. It should be borne in mind that although a double sealing assembly 134 may be used, such is not mandatory. It may be desirable to employ a single sealing member in place of the double sealing assembly 134. Also, although cup-type packers are illustrated in the embodiment shown in FIGS. 2A–2C, other types of sealing members or packers may be employed without departing from the spirit and scope of the present invention. It is only necessary that the lower sealing element 134 be movable in response to fluid treatment pressure within the sealed annulus zone for closing a bypass valve as described below.

As mentioned above, during tool run-in it is desirable to bypass displaced well fluid below the straddle packer tool through the tool and into the wellbore above the tool. Also, during tool pull-out or extraction, it is desirable to bypass well fluid above the tool through the tool and into the wellbore below the tool to thereby minimize the weight of the tubing string and straddle packer tool and thus minimize the force that is required for tool run-out or extraction. During well treatment it is desirable to prevent treatment fluids from previously treated zones from flowing upwardly through the straddle packer tool into the wellbore above the tool. This is accomplished by a sliding sleeve valve 144 and check valve assembly 165. The sliding sleeve valve 144 has a lower annular end 145 that forms a closure for the bypass ports 148 of the tubular section 130 of the lower packer mandrel 120. An annular stop ring 146 is positioned in encircling relation about a lower portion of the external cylindrical surface 132 and rests on the upper annular shoulder 147 of a drain housing 150, with its upper end located below the bypass ports 148. When the sliding sleeve valve 144 has moved downwardly to its maximum extent, blocking flow through the bypass ports 148, its downward movement will be stopped by the upper end of the stop ring 146.

The lower end section of the straddle packer tool 22 is defined by drain housing 150 having drain ports 152 for draining fluid from the wellbore above the straddle packer tool 22 into the wellbore below the lower seal assembly 134. For draining fluid into a conduit that may be connected to the lower end of the tool, a drain port 154 is located centrally of the drain housing 150 to permit fluid to be drained into a receptacle 156 which is defined by a lower tubular extension 158 of the drain housing 150. The lower tubular extension 158 is provided with an internally threaded connector section 160 that, if desired, is adapted to receive a conduit for conducting the fluid downwardly within the well while maintaining the fluid substantially isolated from the annulus between the straddle packer tool 22 and the well casing immediately below the tool. The lower end of the tubular section 130 of the lower packer mandrel 120 is provided with an externally threaded connector section 162 which is threaded into the internally threaded upper end 164 of the drain housing 150. The various interconnected mandrels of the tool collectively define an elongate tool body of generally tubular construction, with the body and its internal tubular components defining the bypass passage and the treatment fluid passage of the tool.

Figure 3:
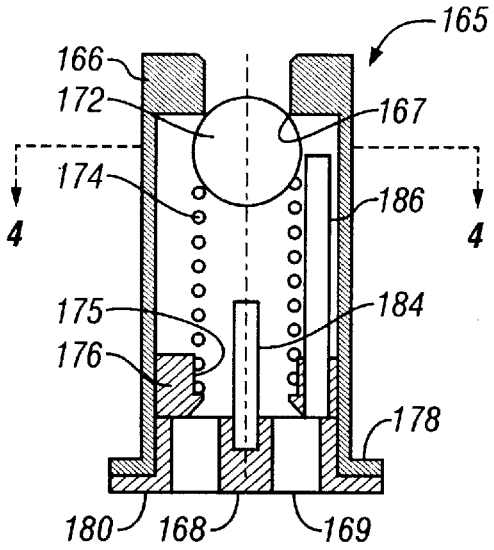
Figure 4:
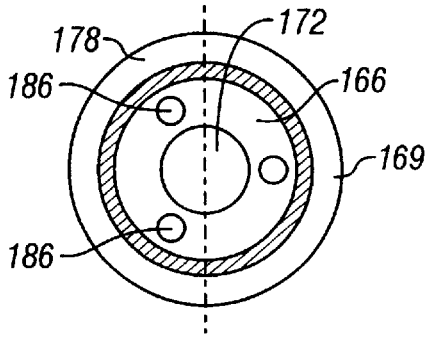

Check valve assembly 165 including a check valve housing 166, shown in FIG. 2C and in greater detail in FIGS. 3 and 4, is located within the lower end of the tubular section 130 and defines an internal annular valve seat 167 (FIG. 3) which is normally engaged by a check valve element 172. The check valve element 172 may be in the form of a ball type check valve as shown or it may have any other suitable check valve configuration. The check valve element 172 is urged to its closed position in engagement with the sharp cornered annular valve seat 167 by a compression spring 174. For centering of the compression spring 174 within the check valve housing 166 the lower end of the compression spring 174 is engaged within a spring receptacle 175 of a spring positioning element 176 that is seated on the lower ported closure member 168. The lower ported closure member 168 defines a plurality of drain ports 169 for draining fluid that enters the check valve housing 166 past the check valve element 172. The lower end of the check valve housing 166 defines a retainer flange 178 which is positioned on a retainer flange 180 of the lower ported closure member 168. The check valve assembly 165 is retained within the lower end of the tubular section 130 by the lower end of the externally threaded connector section 162 of the tubular section 130, which secures the retainer flanges 178 and 180 against an upwardly facing annular shoulder 182 of the upper valve retainer section 170 of the drain housing 150. Downward movement of the check valve element 172 is limited by a centrally located stop post 184 which projects upwardly from the central region of the lower ported closure member 168. To ensure controlled pressure responsive movement of the check valve element 172 and to ensure against lateral buckling of the compression spring, a plurality of valve and spring guide posts 186 are mounted within apertures of the spring positioning element 176 and serve to maintain substantially centralization of the check valve element 172 and the compression spring 174 during pressure responsive check valve movement.

Operation

The straddle packer tool of FIGS. 2A–2C is connected at its upper end to a string of tubing such as coiled tubing, or jointed tubing, such as drill pipe. The tool is run into a well by the tubing with the sliding sleeve valve 144 open, as shown in FIG. 2C, thus permitting well fluid displaced by the tool to flow through the open bypass ports 148 and into the central passage 128, with the check valve assembly 165 remaining closed. The displaced well fluid bypasses the treatment ports by flowing upwardly through the bypass passages 112, which are not in communication with the treatment fluid passage 46 or the treatment ports 98. The displaced well fluid exits the tool at fluid transfer ports 74 and flows into the wellbore above the tool. During running of the tool into the well, differential pressure across the double sealing assembly 134 assists in maintaining the sliding sleeve valve 144 in the open position. When the straddle packer tool 22 has reached its treatment depth within the well, treatment fluid is supplied under pressure via the tubing string 14 which is in communication with the treatment fluid passage 46, with the treatment fluid exiting the treatment ports 98 and flowing into the annulus between the tool and the wellbore or well casing and between the upper and lower sealing assemblies or packers of the tool. Since the lower sealing assembly 134 is movable downwardly by pressure actuation, initial pressuring within the annulus between the tool and the wellbore or well casing and between the upper and lower sealing assemblies causes the lower sealing assembly to be moved downwardly, causing downward or closing movement of the sliding sleeve valve 144. At this point, pressure of the well treatment fluid within the sealed annulus zone 32 is raised to the appropriate treatment pressure.

After the well treatment has been completed, treatment fluid pressurization within the sealed annulus zone is discontinued. With the sliding sleeve valve 144 remaining closed, the straddle packer tool 22 is moved upwardly within the well by application of upward force to the tubing. As the tool is moved upwardly, the hydrostatic pressure of well fluid above the tool acts on the check valve assembly 165, thus opening the check valve and permitting the well fluid above the tool to bypass through the tool and exit the tool past the check valve. This fluid bypass arrangement allows easy pulling of tools from deep treating depths since the bypassing well fluid does not require lifting of a substantial volume of fluid along with the tool. Additionally, as the tool is moved upwardly, differential pressure across the double sealing assembly 134 assists in maintaining the sliding sleeve valve 144 in the closed position.

Figure 5:
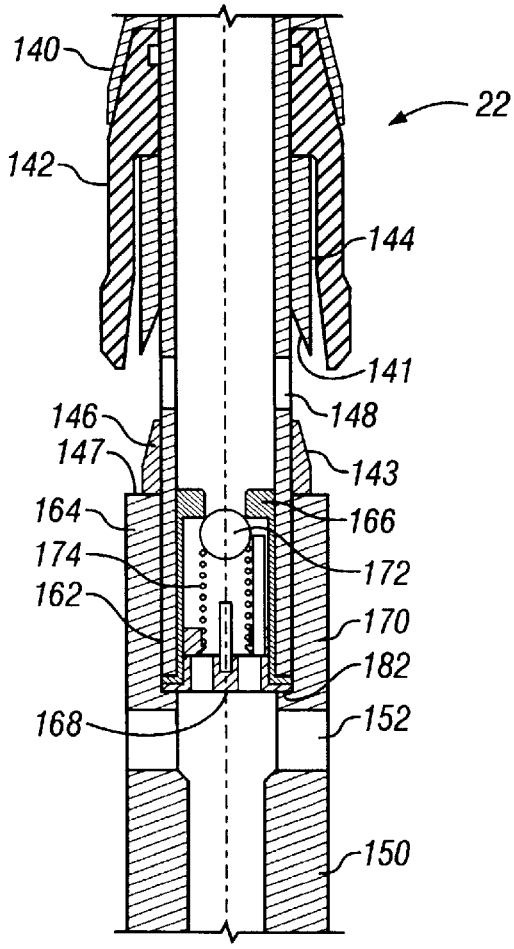

An alternative embodiment of the sliding sleeve valve 144 is illustrated in FIG. 5 which shows the lower section of a straddle packer tool 22 as shown in FIG. 2C. Like parts in FIGS. 2C and 5 are indicated by like reference numerals. To ensure that sliding sleeve valve 144 remains in the closed position after actuation, sliding sleeve valve 144 and valve stop ring 146 have interfitting locking tapers 141 and 143 on their mating ends.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A method for conducting fluid treatment of a well having a wellbore and having a well fluid within the wellbore, comprising:

running a well treatment tool into the wellbore by tubing for conveying said well treatment tool and for conducting treatment fluid to said well treatment tool, said well treatment tool having a treatment fluid passage in communication with the tubing, spaced sealing members for sealing engagement with the wellbore to define a sealed annulus zone between said spaced sealing members and having at least one treatment port in communication with said treatment fluid passage and being open to said sealed annulus zone, said well treatment tool having at least one fluid bypass passage having a check valve permitting only downward flow of fluid through said fluid bypass passage and having a fluid bypass valve having an open position permitting fluid flow through said fluid bypass passage and a closed position preventing upward fluid flow through said fluid bypass passage;

for said running of said well treatment tool, positioning said fluid bypass valve in said open position and displacing well fluid with the well treatment tool and conducting said displaced well fluid through said fluid bypass valve and said fluid bypass passage to the wellbore above the well treatment tool;

after positioning of said well treatment tool at a desired depth within the wellbore moving said fluid bypass valve to said closed position and injecting treatment fluid from said treatment fluid passage into said sealed annulus zone for treating the well; and after treatment of the well, when upward movement of the well treatment tool is desired, maintaining said fluid bypass valve in said closed position for draining of well fluid above said well treatment tool through said check valve to the wellbore below said well treatment tool.

2. The method of claim 1, wherein said spaced sealing members are pressure actuated and one of said spaced sealing members is disposed in actuating relation with said fluid bypass valve, said method further comprising:

during said running of said well treatment tool causing development of differential pressure across said one of said spaced sealing members for moving said one of said spaced sealing members and said fluid bypass valve upwardly relative to said well treatment tool for maintaining said fluid bypass valve in the open position thereof.

3. The method of claim 1, wherein at least one of said spaced sealing members is a pressure actuated cup packer disposed in actuating relation with said fluid bypass valve, and wherein said moving said fluid bypass valve to said closed position is effected by the development of differential pressure across said pressure actuated cup packer.

4. The method of claim 1, wherein at least one of said spaced sealing members is a pair of oppositely facing pressure actuated cup packers disposed in opening and closing actuating relation with said fluid bypass valve, said method further comprising:

during said running of said well treatment tool causing development of upwardly directed differential pressure across said pair of oppositely facing pressure actuated cup packers for moving said oppositely facing pressure actuated cup packers and said fluid bypass valve upwardly relative to said well treatment tool to maintain said fluid bypass valve in said open position; and during said retrieving of said well treatment tool causing development of downwardly directed differential pressure across said pair of pressure actuated cup packers for moving said oppositely facing pressure actuated cup packers and said fluid bypass valve downwardly relative to said well treatment tool to maintain said fluid bypass valve in said closed position.

5. The method of claim 1, wherein said well treatment tool has a bypass port in communication with said fluid bypass passage and said spaced sealing members comprise an upper cup packer facing said sealed annulus zone and a pair of oppositely facing lower cup packers with one of said lower cup packers facing said sealed annulus zone and said fluid bypass valve being a sleeve valve surrounding a portion of said well treatment tool and in said closed position closing said bypass port, said method further comprising:

conducting pressurized treatment fluid from said treatment fluid passage through said treatment port and into said sealed annulus zone, the fluid pressure within said sealed annulus zone developing pressure differential on said upper cup packer and said one of said lower cup packers and causing expansion and sealing thereof with the wellbore and moving said one lower cup packer and said sleeve valve downwardly to close said sleeve valve;

after treatment of the well has been completed, discontinuing said conducting pressurized treatment fluid from said treatment fluid passage through said treatment port and into said sealed annulus zone;

with said sleeve valve closed, applying upward force to said well treatment tool via said tubing for moving said well treatment tool upwardly within the wellbore; and during upward movement of said well treatment tool causing flow of well fluid above said well treatment tool through said bypass passage and through said check valve into the wellbore below said well treatment tool.

6. A straddle packer tool for treatment of a well having a wellbore, comprising:

an elongate tool mechanism defining a treatment fluid passage and at least one bypass passage and having an upper end defining a connection for connection of said elongate tool mechanism to tubing for running and retrieval thereof and for conducting treatment fluid to said treatment fluid passage;

sealing members supported by said elongate tool mechanism and spaced from one another for engaging the wellbore to define a sealed annulus zone between said sealing members;

said elongate tool mechanism defining at least one treatment port communicating said treatment fluid passage with said the sealed annulus zone, defining at least one bypass passage permitting flow of fluid past said at least one treatment port, and defining at least one bypass port communicating said fluid bypass passage with the wellbore below said sealed annulus zone;

a check valve located within said bypass passage permitting downward flow of fluid from said bypass passage into the wellbore below said well treatment tool and preventing upward flow of fluid into said bypass passage;

fluid bypass ports defined by said elongate tool mechanism for conducting fluid flow to and from said bypass passage and the wellbore above and below said sealed annulus zone; and a fluid bypass valve positionable at an open position permitting flow of well fluid within said bypass passage and a closed position preventing the flow of well fluid within said bypass passage.

7. The straddle packer tool of claim 6, wherein:

at least one of said sealing members comprises a packer element for sealing engagement with the wellbore and is disposed in movable relation with said elongate tool mechanism, said packer element being disposed in actuating relation with said fluid bypass valve and moving said fluid bypass valve to said open and closed positions thereof.

8. The straddle packer tool of claim 6, wherein:

at least one of said sealing members comprises a cup packer element for sealing engagement with the wellbore and is disposed in movable relation with said elongate tool mechanism, said cup packer element being oriented for pressure responsive actuation by pressure within said sealed annulus zone; and wherein said cup packer element is disposed in actuating relation with said fluid bypass valve for moving said fluid bypass valve between said open and closed positions thereof responsive to fluid pressure within said sealed annulus zone.

9. The straddle packer tool of claim 6, wherein:

said sealing members each comprise a cup packer element for sealing engagement with the wellbore, said cup packer elements each being oriented for pressure responsive actuation by fluid pressure within said sealed annulus zone; and wherein one of said cup packer elements is disposed in actuating relation with said fluid bypass valve for moving said fluid bypass valve to the closed position thereof when fluid pressure within said sealed annulus zone is greater than wellbore pressure below said sealed annulus zone.

10. The straddle packer tool of claim 9, wherein:

said one of said cup packer elements comprises a double cup packer having first and second packer cups each having an open end and a closed end, said open end of said first packer cup facing said sealed annulus zone and being actuated by treatment fluid pressure within said sealed annulus zone, said open end of said second packer cup facing said wellbore below said sealed annulus zone and being actuated by well pressure within the wellbore below said sealed annulus zone; and wherein said fluid bypass valve is a sleeve valve mounted externally of said elongate tool mechanism and is moved to said open and closed positions by pressure responsive movement of said one of said cup packer elements.

11. The straddle packer tool of claim 9, wherein:

said one of said cup packer elements comprises a double cup packer being movably supported on said elongate tool mechanism and having first and second packer cups each having an open end and a closed end, said open end of said first packer cup facing said sealed annulus zone and being actuated by treatment fluid pressure within said sealed annulus zone, said open end of said second packer cup facing said wellbore below said sealed annulus zone and being actuated by well pressure within the wellbore below said sealed annulus zone;

at least one of said fluid bypass ports is located above said check valve; and wherein said fluid bypass valve is a sleeve valve mounted externally of said elongate tool mechanism moved to said open and closed positions relative to said at least one bypass port by pressure responsive movement of said one of said cup packer elements.

12. A straddle packer well treatment tool for use within a wellbore having well fluid therein, comprising:

a tool body having upper and lower spaced sealing elements for engaging the wellbore and establishing an annulus zone therebetween, said tool body having a treatment fluid passage opening to said annulus zone and a fluid bypass passage extending therethrough and opening to the wellbore above and below said annulus zone and being isolated from said treatment fluid passage; and a bypass valve mounted for movement relative to said tool body to open and closed positions for controlling the flow of well fluid through said bypass passage.

13. The straddle packer well treatment tool of claim 12, wherein said bypass valve comprises means for locking said bypass valve in said closed position upon movement to said closed position.

14. The straddle packer well treatment tool of claim 13, wherein said locking means comprises interfitting locking tapers.

15. The straddle packer well treatment tool of claim 12, further comprising:

a check valve located within said bypass passage and oriented for blocking upward flow of well fluid from the wellbore below said annulus zone and for permitting downward flow of well fluid from the wellbore above the tool body through said check valve to the wellbore below the tool body.

16. The straddle packer well treatment tool of claim 12, wherein:

said bypass valve is a sleeve valve movable relative to said tool body by one of said upper and lower spaced sealing elements and being closed by said one of said upper and lower spaced sealing elements to prevent flow of well fluid from below said tool body through said bypass passage to the wellbore above said tool body.

17. The straddle packer well treatment tool of claim 12, further comprising:

at least one bypass port defined in said tool body and located above said check valve; and wherein said bypass valve is a sleeve valve movable relative to said at least one bypass port and having an open position permitting the flow of well fluid to and from said bypass port and a closed position blocking the flow of well fluid to and from said bypass port.

18. The straddle packer well treatment tool of claim 12, wherein:

said bypass valve is a sleeve valve moved to said closed position by said lower sealing element responsive to pressure within said annulus zone.

19. A straddle packer well treatment tool comprising:

a tool body having upper and lower spaced external sealing elements for engaging a wellbore and establishing a sealed annulus zone therebetween, said tool body having a treatment fluid passage opening to said sealed annulus zone and a fluid bypass passage opening to the wellbore above and below said sealed annulus zone and being isolated from said treatment fluid passage, said lower sealing element being movable relative to said tool body by differential pressure;

a check valve located within said bypass passage oriented for blocking upward flow of well fluid from the wellbore below said sealed annulus zone and for permitting downward flow of well fluid from the wellbore above the tool body through said check valve to the wellbore below the tool body;

at least one bypass port defined in said tool body and located above said check valve; and a bypass valve movable relative to said tool body and having an open position relative to said bypass port to permit flow of well fluid from said bypass passage to the wellbore below said tool body and a closed position relative to said bypass port to block the flow of well fluid through said bypass port and to thus permit the flow of well fluid from said bypass passage into the wellbore below said tool body only through said check valve.

20. The straddle packer well treatment tool of claim 19, wherein:

said upper and lower sealing elements each comprise cup packer elements, said lower cup packer element mounted for pressure responsive movement on said tool body; and wherein said bypass valve is actuated to said open and closed positions by said lower cup packer element.

21. The straddle packer well treatment tool of claim 20, wherein:

said lower cup packer element is a double cup packer having first and second packer cups each having an open end and a closed end, said open end of said first packer cup faces said sealed annulus zone, and said open end of said second packer cup faces said wellbore below said sealed annulus zone.

22. A straddle packer well treatment tool for use within a wellbore having well fluid therein, comprising:

a tool body having upper and lower spaced sealing elements for engaging the wellbore and establishing an annulus zone therebetween, said tool body having a treatment passage opening to said annulus zone and a fluid bypass passage extending therethrough and opening to the wellbore above and below said annulus zone and being isolated from said treatment fluid passage; and a check valve located within said bypass passage, said check valve oriented for blocking upward flow of well fluid from the wellbore below said annulus zone, and for permitting downward flow of well fluid from the wellbore above the tool body through said check valve to the wellbore below the tool body.

23. The straddle packer well treatment tool of claim 22, wherein said check valve is a ball check valve.

* * * * *